US010021915B2

(12) United States Patent
Cadieux et al.

(10) Patent No.: US 10,021,915 B2
(45) **Date of Patent: *Jul. 17, 2018**

(54) ELECTRONIC SMOKING ARTICLE

(71) Applicant: Altria Client Services LLC, Richmond, VA (US)

(72) Inventors: Edmond J. Cadieux, Mechanicsville, VA (US); Geoffrey Brandon Jordan, Midlothian, VA (US); Barry S. Smith, Hopewell, VA (US); Steve R. Rinehart, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/639,409

(22) Filed: Jun. 30, 2017

(65) Prior Publication Data

US 2017/0295849 A1 Oct. 19, 2017

Related U.S. Application Data

(63) Continuation of application No. 14/199,442, filed on Mar. 6, 2014, now Pat. No. 9,723,876.

(60) Provisional application No. 61/787,088, filed on Mar. 15, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/002; A24F 47/008; A61M 15/06; A61M 11/00
USPC ..... 131/329; 128/205.21
See application file for complete search history.

(56) References Cited

U.S. PATENT DOCUMENTS

| | | | |
|---|---|---|---|
| 3,797,865 | A | 3/1974 | Ballentine |
| 8,314,591 | B2 | 11/2012 | Terry et al. |
| 9,675,107 | B2 | 6/2017 | Levitz et al. |
| 2010/0031968 | A1 | 2/2010 | Sheikh et al. |

(Continued)

FOREIGN PATENT DOCUMENTS

| | | | |
|---|---|---|---|
| CN | 201197360 | Y | 2/2009 |
| CN | 201379072 | Y | 1/2010 |

(Continued)

OTHER PUBLICATIONS

International Search Report and Written Opinion dated Feb. 4, 2015.

(Continued)

*Primary Examiner* — Joseph S Del Sole
*Assistant Examiner* — Mohamed K Ahmed Ali
(74) *Attorney, Agent, or Firm* — Harness Dickey & Pierce, P.L.C.

(57) ABSTRACT

An electronic smoking article includes a first section containing a liquid supply reservoir including liquid material, a heater operable to heat the liquid material to a temperature sufficient to vaporize the liquid material and form an aerosol, and a wick in communication with the liquid material and operable to deliver the liquid material to the heater, and a second section containing a power supply. The first section is connected to the second section at a breakaway connection. The breakaway connection includes a weakened region.

20 Claims, 4 Drawing Sheets

(56) References Cited

U.S. PATENT DOCUMENTS

| | | | | |
|---|---|---|---|---|
| 2011/0209717 | A1 | 9/2011 | Han | |
| 2011/0303231 | A1 | 12/2011 | Li et al. | |
| 2012/0145169 | A1 | 6/2012 | Wu | |
| 2012/0279512 | A1 | 11/2012 | Hon | |
| 2013/0192616 | A1 | 8/2013 | Tucker et al. | |
| 2013/0228191 | A1 | 9/2013 | Newton | |
| 2013/0231616 | A1 | 9/2013 | Fangrow et al. | |
| 2014/0253144 | A1* | 9/2014 | Novak, III | G01R 31/327 324/550 |
| 2014/0261486 | A1* | 9/2014 | Potter | A24F 47/008 131/328 |

FOREIGN PATENT DOCUMENTS

| | | | |
|---|---|---|---|
| CN | 101843368 | A | 9/2010 |
| CN | 201781984 | U | 4/2011 |
| CN | 201878765 | U | 6/2011 |
| CN | 201976738 | U | 9/2011 |
| CN | 102264250 | A | 11/2011 |
| CN | 202085724 | U | 12/2011 |
| CN | 202127820 | U | 2/2012 |
| CN | 202407083 | U | 9/2012 |
| CN | 103687503 | A | 3/2014 |
| EP | 1947965 | A2 | 7/2008 |
| EP | 2022350 | A1 | 2/2009 |
| GB | 381876 | A | 10/1932 |
| KZ | 11053 | B | 12/2001 |
| KZ | 26638 | B | 12/2012 |
| RU | 92305 | U1 | 3/2010 |
| WO | WO-9406314 | A1 | 3/1994 |
| WO | WO-2007012007 | A2 | 1/2007 |
| WO | WO-2010133334 | A1 | 11/2010 |
| WO | WO-2012/142293 | A2 | 10/2012 |

OTHER PUBLICATIONS

European Search Report with Application No. 16172685.6 dated Oct. 25, 2016.

Office Action from corresponding Kazakhstan patent application 2015/1184.1, dated Dec. 14, 2016.

Chinese Office Action for corresponding Application No. 201480021592.3 dated Apr. 24, 2017 and English translation thereof.

United States Office Action for corresponding U.S. Appl. No. 15/354,201 dated Sep. 27, 2017.

Examination Report dated Oct. 12, 2017 in related EP Application 14714506.4.

Office Action for Coorresponding Chinese Application No. 201480021592.3 dated Dec. 12, 2017 and English Translation thereof.

Final Office Action dated Mar. 7, 2018 issued in U.S. Appl. No. 15/354,201.

Russian Office Action and English translation thereof dated Mar. 7, 2018.

* cited by examiner

ELECTRONIC SMOKING ARTICLE

CROSS-REFERENCE TO RELATED APPLICATIONS

This application is a continuation of U.S. patent application Ser. No. 14/199,442, filed on Mar. 6, 2014, which claims priority under 35 U.S.C. § 119(e) to U.S. Provisional Application No. 61/787,088, filed on Mar. 15, 2013, the entire contents of each of which are incorporated herein by reference thereto.

SUMMARY OF SELECTED FEATURES

An electronic smoking article (electronic cigarette, electronic cigar or the like) is provided which includes a heater element which vaporizes liquid material to produce an aerosol or "vapor". The heater element preferably comprises a resistive heater coil with a wick extending therethrough and into a liquid supply reservoir.

The electronic smoking article preferably includes a breakaway connection such as a cartridge (cathode) connector piece designed to prevent accidental exposure of fibrous media and wick materials containing a nicotine solution and/or other liquid if the electronic smoking article is inadvertently broken. To facilitate breaking at a location upstream of the liquid supply reservoir, heater and wick, the breakaway connection can comprise a connector piece having a weakened region which causes the connector piece to break apart when the electronic smoking article is subjected to a bending force above a threshold breaking force. Preferably, the connector piece is a cartridge (cathode) connector having an annular, circumferential recess, which is operable to increase stress adjacent thereto so as to cause the cartridge connector piece to break at the annular recess.

DETAILED DESCRIPTION

Figure 9:
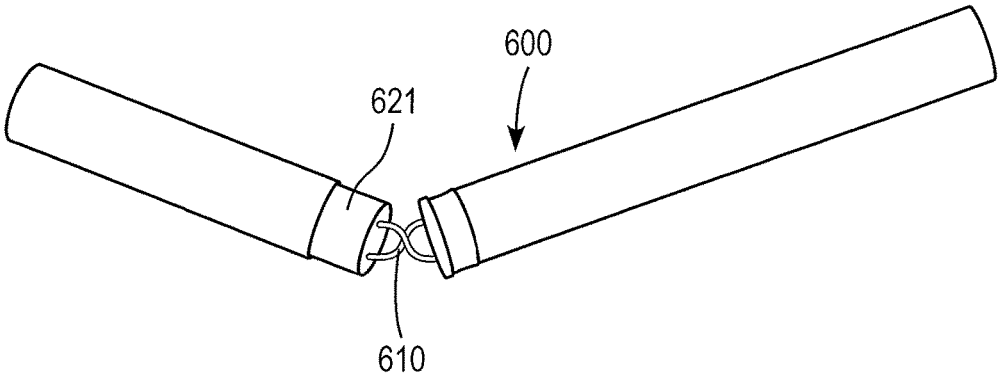
FIG. 9 (Prior Art)
FIG. 9 is an illustration of a prior art electronic smoking article that is broken.

Electronic smoking articles can include two sections mated together at a threaded connection. Occasionally, the electronic smoking articles may break when inadvertently bent. As shown in FIG. 9, when broken, prior mi electronic smoking articles 600 typically break in the casing downstream of the threaded connection such that electrical wires 610, fibrous media 621 and liquid material are released from the electronic smoking article 600.

As described herein, an electronic smoking article includes an improved breakaway connection, which is designed to break at weakened region of the connection so as to prevent accidental release of liquid material, fibrous media and/or electrical wires from the broken electronic smoking article. Thus, if the electronic smoking article including the breakaway connection is bent beyond a threshold breaking force, the breakaway connection will break at the weakened region of the cartridge connector and/or a portion of the connector remains with the liquid containing cartridge so that the liquid supply reservoir remains sealed. Preferably, the connector extends in a longitudinal direction within an electronic smoking article and has a weakened region at a location along a length thereof. The weakened region can include an annular recess and/or one or more holes extending radially from the annular recess to a central passage of the breakaway connection. The breakaway connection can be a connector piece such as a cathode connector piece. The breakaway connection can include a threaded joint or other suitable connection, such as a snap fit connection, friction fit connection or other suitable arrangement.

Figure 1:
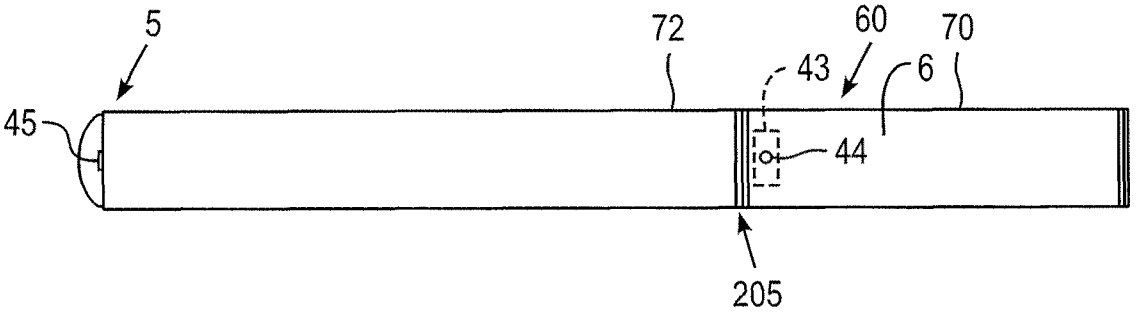
FIG. 1 is a top planar view of an electronic smoking article according to a first embodiment.
Figure 2:
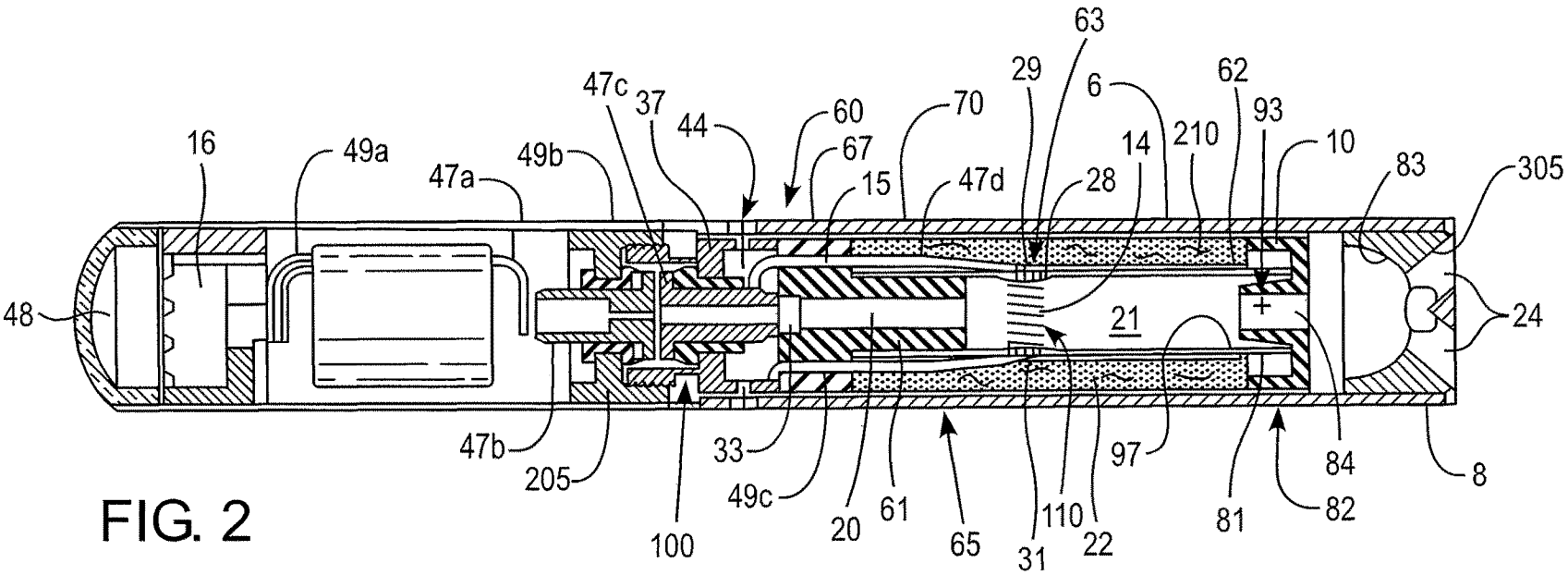
FIG. 2 is a side cross-sectional view of the electronic smoking article shown in FIG. 1.

Referring to FIGS. 1 and 2, the electronic smoking article 60 is provided and comprises a replaceable cartridge (cartomizer or first section) 70 and a reusable fixture (battery or second section) 72, which in a preferred embodiment are coupled together at a connection 205. The connection can be a threaded connection, a friction fit connection, or a snap fit connection. Preferably, the connection 205 includes a cathode connector piece 37. Generally, the second section 72 includes a puff sensor 16 responsive to air drawn into the second section 72 via an air inlet port 45 adjacent the free end or tip of the smoking article 60, a battery 1 and control circuitry integrally arranged with the puff sensor 16. The disposable first section 70 includes a liquid supply reservoir of 22 including liquid and optionally fibrous media 210 and a heater-wick element such as a heater 14 and a wick 28 that wicks liquid from the liquid supply reservoir 22 and heats the liquid to form an aerosol in a central air channel 21. Upon completing the connection 205, the battery 1 is electrically connected with the heater element 14 of the first section 70 upon actuation of the puff sensor. Air is drawn primarily into the first section 70 through one or more air inlets 44.

Heretofore electronic smoking articles, when bent, had been known to break in a manner that would cause a rupture of the cartridge casing or body, thereby releasing liquid contained in the cartomizer section. To address this problem, the electronic smoking article 60, described herein, includes a breakaway portion preferably located in a connector piece such as a cathode connector piece 37, which is designed to break at the connector piece 37 such that a portion of the broken connector 37 remains with the cartridge such that the liquid supply reservoir 22 remains intact and accidental release of liquid is avoided.

The electronic smoking article can be disposable or reusable. In a preferred embodiment, the electronic smoking article is reusable and once the liquid of the cartomizer section is spent, only the first (cartomizer) section 70 is replaced. In a disposable electronic smoking article, the breakaway connector can be located between a liquid storage area and the power supply.

In a preferred embodiment, the electronic smoking article 60 is about the same size as a conventional cigarette. In some embodiments, the electronic smoking article 60 can be about 80 mm to about 110 mm long, preferably about 80 mm to about 100 mm long and about 7 mm to about 8 mm in diameter. For example, in a preferred embodiment, the electronic smoking article is about 84 mm long and has a diameter of about 7.8 mm.

The first section 70 includes an outer tube (or casing) 6 extending in a longitudinal direction and an inner tube (or chimney) 62 coaxially positioned within the outer tube 6. Preferably, a nose portion 61 of an upstream gasket (or seal) 15 is fitted into an upstream end portion 65 of the inner tube 62, while at the same time, an outer perimeter 67 of the gasket 15 provides a liquid-tight seal with an interior surface 97 of the outer casing 6. The upstream gasket 15 also includes a central, longitudinal air passage 20, which opens into an interior of the inner tube 62 that defines a central channel 21. A transverse channel 33 (shown in FIG. 2) at an upstream portion of the gasket 15 intersects and communicates with the central channel 20 of the gasket 15. This channel 33 assures communication between the central channel 20 and a space 35 (see FIG. 2) defined between the gasket 15 and the cathode connector piece 37.

Preferably, at least one adhesive-backed label is applied to the outer tube 6. The label completely circumscribes the electronic smoking article 60 and can be colored and/or textured to provide the look and/or feel of a traditional cigarette. The label can include holes therein which are sized and positioned so as to prevent blocking of the air inlets 44.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. Preferably, the material is light and non-brittle. The inner tube 62 is preferably formed from a woven fiberglass.

In a preferred embodiment, and shown in FIGS. 3A, 3B, 4, 5 and 8, the cathode connector piece 37 includes at its upstream end portion a threaded section 103 for threading into the connector piece 49*b* of the battery section 72 so as to establish the threaded connection 205. The cathode connector piece 37 of the cartridge section 70 also includes an annular (circumferential) recess 100 adjacent the threaded section 103 and a cylindrical portion 301 at the downstream portion of the connector piece 37 that slidingly receives the outer casing 6 until the casing 6 stops at a rim 111. The annular recess 100 can be continuous about the circumference of the cathode connector piece 37 or can be discontinuous. Preferably, the annular recess 100 is inset from an external surface 104 of the threaded section 103 by about 0.2 to about 0.6 mm, preferably about 0.5 mm. In an embodiment, the wall of the piece 37 at the recess 100 is reduced to about 0.003 inch thickness. In a preferred embodiment the recess 100 may have a wall thickness in the range of about 0.07 to about 0.16 mm. Additionally, the annular recess 100 is about 0.2 to about 0.6 mm wide, preferably about 0.5 mm wide.

Figure 5:
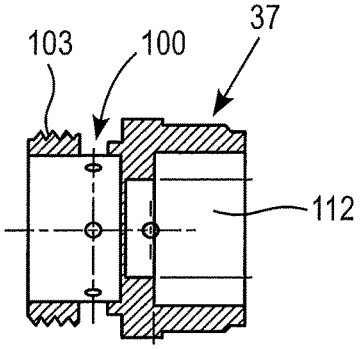
FIG. 5 is a cross-sectional view of the cathode connector piece of FIGS. 3A and 4.

Moreover, spaced apart, radially extending holes 102 can be formed about the circumference of the annular recess 100 and intersect with a central passage 112 of the cathode connector piece 37, as shown in FIG. 5. The holes 102 can be spaced about 45° to about 90° apart and the cathode connector piece 37 can include two to eight holes 102. In a preferred embodiment, the annular recess 100 includes six holes spaced about 60° apart, each having a diameter approximately equal to the width of the recess 100.

In a preferred embodiment, the cathode connector piece 37 is formed of a conductive material, such as one or more electrically conductive metals selected from the group consisting of silver, zinc, nickel, aluminum, copper, tin, iron, aluminum, lead, and combinations thereof.

Figure 6:
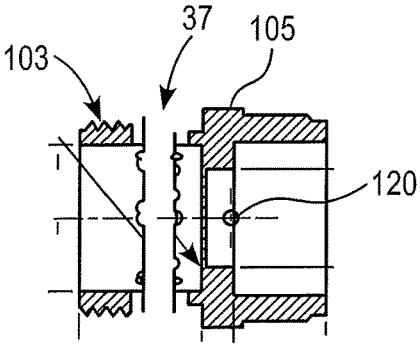
FIG. 6 is an illustration the connector piece of FIG. 3A in a broken condition.
Figure 7:
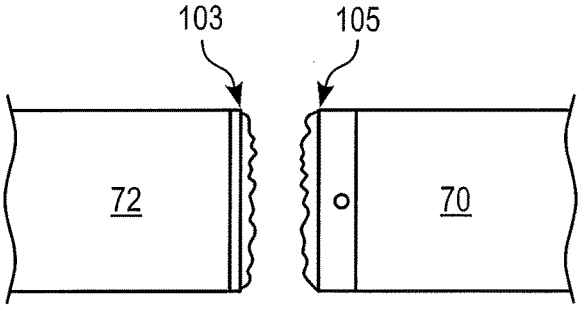
FIG. 7 is an illustration of the electronic smoking article of FIG. 3A after being broken at the connector piece.

In use, if the electronic smoking article 60 is subjected to a strong enough bending force, the electronic smoking article 60 breaks at the annular recess 100, which acts as a weak point in the cathode connector piece 37. The holes 102 aid in weakening the annular recess 100. Accordingly, as shown in FIGS. 6 and 7, when the electronic smoking article 60 breaks, the break is preferably a brittle fracture at the annular recess 100 such that the threaded section 103 remains connected to connector 49*b* of the second section 72 of the electronic smoking article 60 and a fractured body portion 105 of the cathode connector piece 37 remains connected with the casing 6 of the first section 70 of the electronic smoking article 60.

Figure 3A:
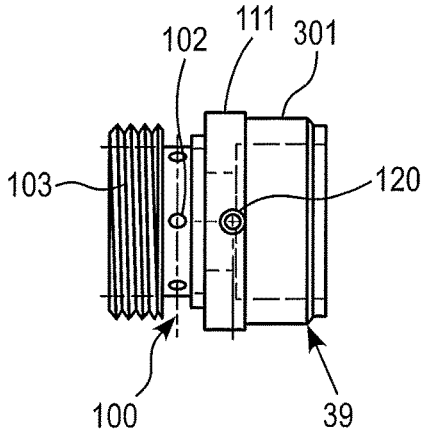
FIG. 3A is a side view of a connector piece as described herein and FIG. 3B is a side view of a first section of an electronic smoking article connected to a second section of the electronic smoking article using the cathode connector piece of FIG. 3A.
Figure 3B:
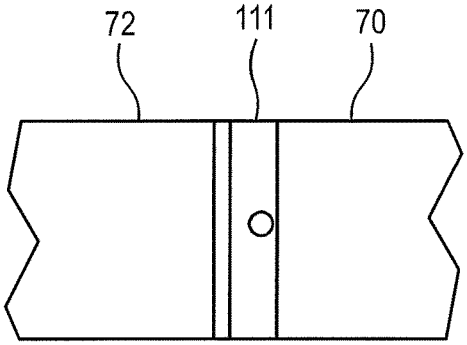
Figure 4:
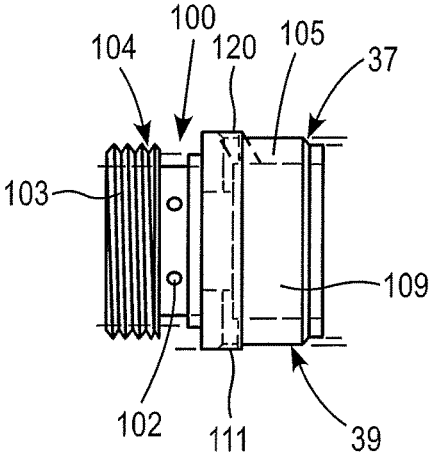
FIG. 4 is a side view of the cathode connector piece of FIG. 3A turned 90 degrees.
Figure 8:
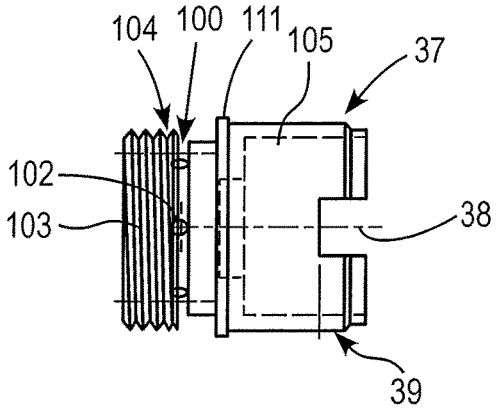
FIG. 8 is an illustration of a connector piece of a second embodiment.

In an embodiment, as shown in FIG. 8, the cathode connector piece 37 can include opposing notches 38 about its perimeter 39, which, upon insertion of the cathode connector piece 37 into the casing (outer tube) 6, are aligned with the location of each of two RTD-controlling, air inlets 44 and 44' in the outer casing 6 so as to allow air flow into the central air channel 21 via the central air passage 20 in the gasket 15. The notches 38 can be about 1.0 to about 3.0 mm wide, preferably about 2.0 mm wide. If desired, the cathode connector piece 37 can include additional notches 38. Alternatively, a single air inlet 44 can be included. Alternatively, as shown in FIG. 3A, an air hole 120 formed in the rim 111 of the connector piece 37 permits airflow into the electronic smoking article 60.

In a preferred embodiment, as shown in FIGS. 1 and 2, the electronic smoking article 60 includes at least one air inlet 44 formed in the outer tube 6, preferably adjacent the threaded connection 205. In a preferred embodiment, the air inlets 44, 44' are sized and configured such that the electronic smoking article 60 has a RTD in the range of from about 60 mm H2O to about 150 mm H2O, more preferably about 90 mm H2O to about 110 mm H2O, most preferably about 100 mm H2O to about 130 mm H2O.

In a preferred embodiment, the second (battery) section 72 includes an air inlet 45 at an upstream end 5 of the smoking article 60, which is sized just sufficient to assure proper operation of the puff sensor 16, located nearby. Drawing action upon the mouth end insert 8 is communicated to the air inlet port 45 through the central air channel provided in the anode post 47*c* of the first section 70 and the anode connection post 47*b* of the second section 72 and along space 13 between the battery 1 and the casing of the second section 72. The air inlet port 45 is sized such that the airflow rate therethrough is much smaller than the airflow rates through the air inlets 44, 44', so that the impact on RTD is minimized and consistency in RTD is maintained. For example, each air inlet 44,44' can be less than about 2.0 mm in width and less than about 1.5 mm in length.

Figure 10:
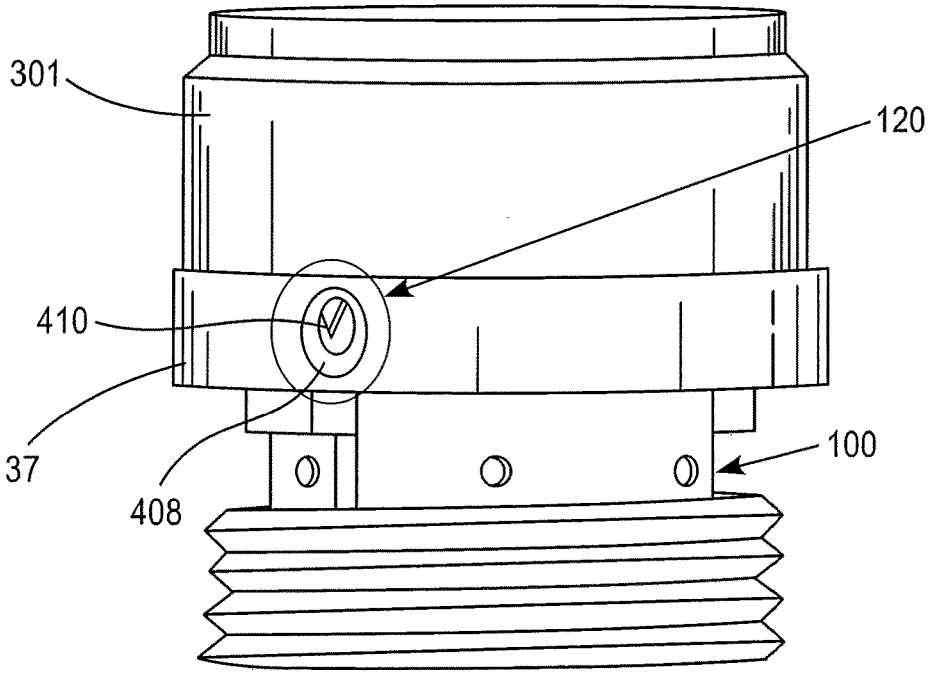
FIG. 10 is a side view of a connector piece showing details of an improved air-inlet.
Figure 11:
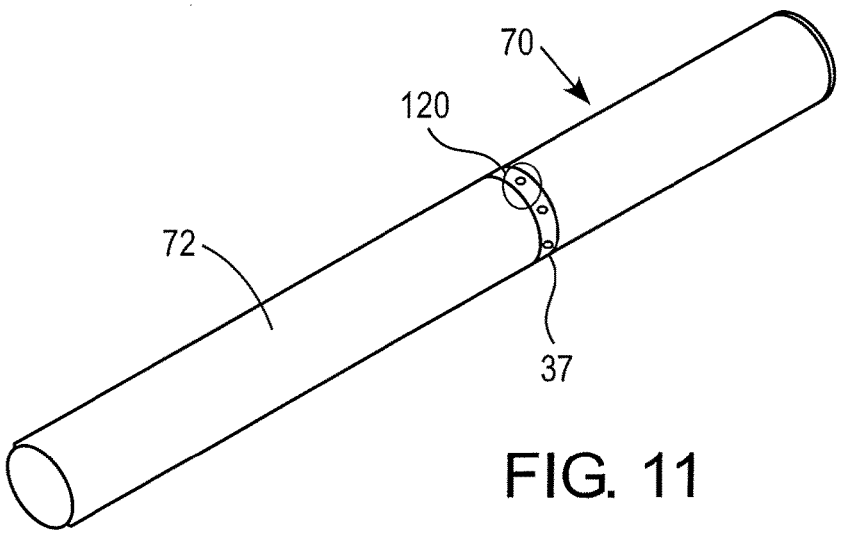
FIG. 11 is a perspective view of an electronic smoking article comprising the air-inlet of FIG. 10.

Referring now to FIGS. 10 and 11, the air inlet 120 preferably comprises a beveled entrance 408 and an angled passageway for 410. In a preferred embodiment, the smoking article includes a pair of air inlets 120. Each of the air inlets 120 are angled toward the mouth end of the smoking article at an angle in the range of about 35 to about 55 degrees, more preferably at about 40 to about 50 degrees, most preferably about 45 degrees. Such arrangement minimizes (abates) "whistling" noise during a puff.

In an embodiment, a cylindrical downstream portion 301 of the connector piece 37, which slidingly receives the casing 6 of the cartridge 70, is provided additional length so as to strengthen the engagement between the connector piece 37 and the casing 6. In an embodiment, the length of the upstream portion 301 was increased by approximately 30% (from about 3.4 mm to about 4.4 mm) to strengthen the engagement as compared to other embodiments.

Preferably, a nose portion 93 of a downstream gasket 10 is fitted into a downstream end portion 81 of the inner tube 62. An outer perimeter 82 of the gasket 10 provides a substantially liquid-tight seal with an interior surface 97 of the outer casing 6. The downstream gasket 10 includes a central channel 84 disposed between the central passage 21 of the inner tube 62 and the interior of the mouth end insert 8 and which communicates aerosol from the central passage 21 to the mouth end insert 8.

In a preferred embodiment, the liquid supply reservoir 22 is contained in an outer annulus between inner tube 62 and outer tube 6 and between the gaskets 10 and 15. Thus, the liquid supply reservoir 22 at least partially surrounds the central air passage 21. The liquid supply reservoir 22 comprises a liquid material and optionally a liquid storage medium operable to store the liquid material therein.

Preferably, the liquid storage medium is a fibrous material comprising cotton, polyethylene, polyester, rayon and combinations thereof. Preferably, the fibers have a diameter ranging in size from about 6 microns to about 15 microns (e.g., about 8 microns to about 12 microns or about 9 microns to about 11 microns). The liquid storage medium can be a sintered, porous, sponge, or foamed material. Also preferably, the fibers are sized to be irrespirable and can have a cross-section which has a y shape, cross shape, clover shape or any other suitable shape. In one embodiment, the liquid storage medium may comprise a winding of cotton gauze or other fibrous material about the inner tube 62.

Also preferably, the liquid material has a boiling point suitable for use in the electronic smoking article 60. If the boiling point is too high, the heater element 14 will not be able to vaporize the liquid. However, if the boiling point is too low, the liquid may vaporize even when the heater element 14 is not activated.

Preferably, the liquid material includes a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material and/or a nicotine-free material. For example, the liquid may include water, solvents, ethanol, plant extracts and natural or artificial flavors. Preferably, the liquid further includes an aerosol former. Examples of suitable aerosol formers are glycerin and propylene glycol.

In use, liquid material is transferred from the liquid supply reservoir 22 and/or liquid storage medium 210 in proximity of the 14 heater by capillary action of the wick 28. In one embodiment, the wick 28 has a first end portion 29 and a second end portion 31. The first end 29 and the second end 31 extend into opposite sides of the liquid supply reservoir 22 for contact with liquid material contained therein. Also preferably, the heater 14 at least partially surrounds a central portion of the wick 28 such that when the heater 14 is activated, the liquid in the central portion of the wick 28 is vaporized by the heater 14 to form an aerosol.

The wick 28 preferably comprises filaments having a capacity to draw a liquid, more preferably a bundle of glass (or ceramic) filaments and most preferably a bundle comprising a group of strands of glass filaments, preferably three of such strands, all which arrangements are capable of drawing liquid via capillary action via interstitial spacings between the filaments. Preferably, the wick 28 is flexible and includes three strands, each strand including a plurality of intertwined filaments. Moreover, it is noted that the end portions of the 29 and 31 of the wick 28 are flexible and foldable into the confines of the liquid supply reservoir 22.

Advantageously, the liquid material in the liquid supply reservoir 22 is protected from oxygen (because oxygen cannot generally enter the liquid supply reservoir 22 via the wick 28). In a preferred embodiment, the liquid material is also protected from light so that the risk of degradation of the liquid material is significantly reduced. Thus, a high level of shelf-life and cleanliness can be maintained.

In a preferred embodiment, the liquid supply reservoir 22 is sized and configured to hold enough liquid material such that the electronic smoking article 60 is operable for smoking for at least about 200 seconds, preferably at least about 250 seconds, more preferably at least 300 seconds and most preferably at least about 350 seconds. Thus, liquid supply reservoir 22 is equivalent to about one pack of traditional cigarettes. Moreover, the electronic smoking article 60 can be configured to allow each puff to last a maximum of about 5 seconds.

Referring to FIG. 2, the first section 70 also includes a mouth end insert 8 having at least two diverging outlets 24 (e.g., 3, 4, 5 or more, preferably 2 to 10 outlets or more, more preferably 6 to 8 outlets, even more preferably 2 to 6 outlets 24 or 4 outlets 24). Preferably, the outlets 24 are located off-axis and are angled outwardly in relation to the central channel 21 of the inner tube 62 (i.e., divergently). Also preferably, the mouth end insert (or flow guide) 8 includes outlets 24 uniformly distributed about the perimeter of mouth end insert 8 so as to substantially uniformly distribute aerosol in a smoker's mouth during use and create a greater perception of fullness in the mouth. Thus, as the aerosol passes into a smoker's mouth, the aerosol enters the mouth and moves in different directions so as to provide a full mouth feel. In contrast, electronic smoking article a having a single, on-axis orifice tend to direct its aerosol as single jet of greater velocity toward a more limited location within a smoker's mouth.

In addition, the diverging outlets 24 are arranged and include interior surfaces such that droplets of unaerosolized liquid material, if any, that may be entrained in the aerosol impact the interior surfaces 83 of the mouth end insert 8 and/or impact portions of walls 305 which define the diverging outlet passages 24. As a result such droplets are substantially removed or broken apart, to the enhancement of the aerosol.

In a preferred embodiment, the diverging outlet passages 24 are angled at about 5° to about 60° with respect to the longitudinal axis of the outer tube 6 so as to more completely distribute aerosol throughout a mouth of a smoker during use and to remove droplets. In a preferred embodiment, there are four diverging outlet passages 24 each at an angle of about 40° to about 50° with respect to the longitudinal axis of the outer tube 6, more preferably about 40° to about 45° and most preferably about 42°.

Preferably, each of the diverging outlet passages 24 has a diameter ranging from about 0.015 inch to about 0.090 inch (e.g., about 0.020 inch to about 0.040 inch or about 0.028 inch to about 0.038 inch).

The mouth end insert 8 may be integrally affixed within the tube 6 of the cartridge 70. Moreover, the mouth end insert 8 can be formed of a polymer selected from the group consisting of low density polyethylene, high density polyethylene, polypropylene, polyvinylchloride, polyetheretherketone (PEEK) and combinations thereof. The mouth end insert 8 may also be colored if desired.

In a preferred embodiment, the power supply 1 includes a battery arranged in the electronic smoking article 60 such that the anode 47*a* is downstream of the cathode 49*a*. A battery anode connection post 47*b* of the second section 72 preferably contacts the battery anode 47*a*.

More specifically, electrical connection between the anode 47*a* of the battery 1 and the heater coil 14 in the first section 70 is established through a battery anode connection post 47*b* in the second section 72 of the electronic smoking article 60, an anode post 47*c* of the cartridge section 70 and an electrical lead 47*d* connecting a rim portion of the anode post 47*c* with an electrical lead the heater element 14. Likewise, electrical connection between the cathode 49*a* of the battery 1 and the other lead of the heater coil 14 is established through the threaded connection 205 between a cathode connection fixture 49*b* of the second portion 72 and the cathode connector piece 37 of the first section 70 and from there through an electrical lead 49*c* which electrically connects the fixture 37 to the opposite lead 47*d* of the heater coil 14.

Preferably, the electrical leads 47*d*, 49*c* and the heater leads are highly conductive and temperature resistant while the coiled section 110 of the heater 14 is highly resistive so that heat generation occurs primarily along the coils 110 of the heater 14. Also preferably, the electrical lead 47*d* is connected to the heater lead by crimping. Likewise, the electrical lead 49*c* is connected to the heater lead by crimping. In an alternative embodiment, the electrical leads 47*d*, 49*c* can be attached to the heater leads via soldering. Crimping is preferred as it speeds manufacture.

Upon a breach of the annular recess 100, the electrical leads 47*d* and 49*c*, together with the contents of the liquid supply reservoir 22, remain contained within the cartridge section 70.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted or in the case of lithium polymer battery, a minimum voltage cut-off level is achieved.

Alternatively, the power supply 1 may be rechargeable and include circuitry allowing the battery to be chargeable by an external charging device. In that case, preferably the circuitry, when charged, provides power for a pre-determined number of puffs, after which the circuitry must be re-connected to an external charging device. To recharge the electronic smoking article 60, an USB charger or other suitable charger assembly can be used.

Preferably, the electronic smoking article 60 also includes control circuitry including a puff sensor 16. The puff sensor 16 is operable to sense an air pressure drop and initiate application of voltage from the power supply 1 to the heater 14. As shown in FIG. 2, the control circuitry can also include a heater activation light 48 operable to glow when the heater 14 is activated. Preferably, the heater activation light 48 comprises an LED and is at an upstream end of the electronic smoking article 60 so that the heater activation light 48 takes on the appearance of a burning coal during a puff. Moreover, the heater activation light 48 can be arranged to be visible to the smoker. In addition, the heater activation light 48 can be utilized for cigarette system diagnostics or to indicate that recharging is in progress. The light 48 can also be configured such that the smoker can activate and/or deactivate the light 48 for privacy, such that the light 48 would not activate during smoking if desired.

Preferably, the at least one air inlet 45, shown in FIG. 1, is located adjacent the puff sensor 16, such that the puff sensor 16 senses air flow indicative of a smoker taking a puff and activates the power supply 1 and the heater activation light 48 to indicate that the heater 14 is working.

A control circuit is preferably integrated with the puff sensor 16 and supplies power to the heater 14 responsive to the puff sensor 16, preferably with a maximum, time-period limiter.

Alternatively, the control circuitry may include a manually operable switch for a smoker to initiate a puff. The time-period of the electric current supply to the heater may be pre-set depending on the amount of liquid desired to be vaporized. Alternatively, the circuitry may supply power to the heater 14 as long as the puff sensor 16 detects a pressure drop.

Preferably, when activated, the heater 14 heats a portion of the wick 28 surrounded by the heater for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

Preferably, the heater 14 is a wire coil that surrounds the wick 28. Examples of suitable electrically resistive materials include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater can be formed of nickel aluminide, a material with a layer of alumina on the surface, iron aluminide and other composite materials, the electrically resistive material may optionally be embedded in, encapsulated or coated with an insulating material or vice-versa, depending on the kinetics of energy transfer and the external physicochemical properties required. Preferably, the heater 14 comprises at least one material selected from the group consisting of stainless steel, copper, copper alloys, nickel-chromium alloys, super alloys and combinations thereof. In a preferred embodiment, the heater 14 is formed of nickel-chromium alloys or iron-chromium alloys, although the latter is not preferred for reasons which follow. In another embodiment, the heater 14 can be a ceramic heater having an electrically resistive layer on an outside surface thereof.

In another embodiment, the heater 14 may be constructed of an iron-aluminide (e.g., FeAl or Fe3Al), such as those described in commonly owned U.S. Pat. No. 5,595,706 to Sikka et al., or nickel aluminide (e.g., Ni3Al). Use of iron-aluminide is advantageous in that iron-aluminide exhibits high resistivity. FeAl exhibits a resistivity of approximately 180 micro-ohms, whereas stainless steel exhibits approximately 50 to 91 micro-ohms. The higher resistivity lowers current draw or load on the power source (battery) 1.

In a preferred embodiment, the heater coil 14 is formed from a nickel-chromium alloy that is essentially free of iron content. Experience has indicated that heater coils constructed from an iron chromium alloy suffered oxidation of their iron content if the alloys were contacted with water during manufacturing operations, during shelf-life and/or operation of the device.

In a preferred embodiment, the inner tube 62 is constructed from woven fiberglass. Moreover, In a preferred embodiment, the inner tube 62 has a diameter of about 4 mm and opposing slots 63 therein having major and minor dimensions of about 2 mm by about 4 mm Preferably, the end portions 29, 31 of the wick 28 extend through the opposing slots 63.

In one embodiment, the heater 14 comprises a wire coil which at least partially surrounds the wick 28. In that embodiment, preferably the wire is a metal wire and/or the heater coil may extend fully or partially along the length of the wick 28. The heater coil 14 may extend fully or partially around the circumference of the wick 28. In another embodiment, the heater coil is not in contact with the wick 28.

Preferably, the heater 14 heats liquid in the wick 28 by thermal conduction. Alternatively, heat from the heater 14 may be conducted to the liquid by means of a heat conductive element or the heater 14 may transfer heat to the incoming ambient air that is drawn through the electronic smoking article 60 during use, which in turn heats the liquid by convection.

In a preferred embodiment, the wick 28 comprises filaments and comprises a bundle of glass filaments. For example, the wick 28 may include a plurality of filaments. The filaments or threads may be generally aligned in a direction perpendicular (transverse) to the longitudinal direction of the electronic smoking article. Preferably, the wick 28 includes 1 to 8 filaments, more preferably 2 to 6 filaments. In a preferred embodiment, the wick 28 includes 3 strands, each strand comprising a plurality of glass filaments twisted together.

In a preferred embodiment, the structure of the wick 28 is formed of filaments through which the liquid can be transported to the heater 14 by capillary action. The wick 28 can include filaments having a cross-section which is generally cross-shaped, clover-shaped, Y-shaped or in any other suitable shape.

Preferably, the wick 28 includes any suitable material or combination of materials. Examples of suitable materials are glass, ceramic- or graphite-based materials. Moreover, the wick 28 may have any suitable capillarity drawing action to accommodate aerosol generating liquids having different liquid physical properties such as density, viscosity, surface tension and vapor pressure. The capillary properties of the wick 28, combined with the properties of the liquid, ensure that the wick 28 is always wet in the area of the heater 14 to avoid overheating of the heater 14.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. A cartridge of an electronic vaping device comprising: an outer housing extending in a longitudinal direction; a reservoir configured to store a pre-vapor formulation; a vaporizer in fluid communication with the reservoir, the vaporizer configured to vaporize the pre-vapor formulation; and a first connector piece, the first connector piece extending in the longitudinal direction, the first connector piece including, a weakened region at a location along a length of the first connector piece, the first connector piece configured to break at the weakened region if the electronic vaping device is bent beyond a threshold breaking force.

2. The cartridge of claim 1, wherein the weakened region comprises:

a recess adjacent a threaded portion of the first connector piece.

3. The cartridge of claim 2, wherein the weakened region further comprises:

a plurality of holes through the recess, the plurality of holes being at spaced locations about the recess.

4. The cartridge of claim 3, wherein the holes are spaced about 45° to about 90° apart and the first connector piece includes two to eight holes.

5. The cartridge of claim 2, wherein the recess is discontinuous about a circumference of the first connector piece.

6. The cartridge of claim 2, wherein the recess is continuous about a circumference of the first connector piece.

7. The cartridge of claim 2, wherein the recess has a width ranging from about 0.2 mm to about 0.6 mm wide.

8. The cartridge of claim 2, wherein the recess has a depth ranging from about 0.2 mm to about 0.6 mm.

9. The cartridge of claim 1, wherein the first connector piece comprises:

a body portion including a notch about a circumference of the body portion.

10. The cartridge of claim 9, wherein the notch has a width ranging from about 1.0 mm to about 3.0 mm.

11. The cartridge of claim 1, wherein the reservoir is sealed with a gasket, the gasket between the first connector piece and a first end of the cartridge.

12. An electronic vaping device comprising: a first section including, an outer housing extending in a longitudinal direction, a reservoir configured to store a pre-vapor formulation, a vaporizer in fluid communication with the reservoir, the vaporizer configured to vaporize the pre-vapor formulation, and a first connector piece, the first connector piece extending in the longitudinal direction, the first connector piece including, a weakened region at a location along a length of the first connector piece, the first connector piece configured to break at the weakened region if the electronic vaping device is bent beyond a threshold breaking force; and a second section including, a second outer housing extending in the longitudinal direction, a power supply in the second outer housing, and a second connector piece connectable with the first connector piece.

13. The electronic vaping device of claim 12, wherein the weakened region comprises:

a recess adjacent a threaded portion of the first connector piece.

14. The electronic vaping device of claim 13, wherein the weakened region further comprises:

a plurality of holes through the recess, the plurality of holes being at spaced locations about the recess.

15. The electronic vaping device of claim 14, wherein the holes are spaced about 45° to about 90° apart and the first connector piece includes two to eight holes.

16. The electronic vaping device of claim 13, wherein the recess is discontinuous about a circumference of the first connector piece.

17. The electronic vaping device of claim 13, wherein the recess is continuous about a circumference of the first connector piece.

18. The electronic vaping device of claim 13, wherein the recess has a width ranging from about 0.2 mm to about 0.6 mm wide.

19. The electronic vaping device of claim 13, wherein the recess has a depth ranging from about 0.2 mm to about 0.6 mm.

20. The electronic vaping device of claim 12, wherein the first connector piece comprises:

a body portion including a notch about a circumference of the body portion, the notch having a width ranging from about 1.0 mm to about 3.0 mm.

* * * * *